US006126436A

United States Patent [19]

Cabrera et al.

[11] Patent Number: 6,126,436

[45] Date of Patent: Oct. 3, 2000

[54] SOUND ENHANCING BURNER ENCLOSURE FOR FURNACE

[75] Inventors: Robert E. Cabrera, Franklin; Terry E. Hill, Murfreesboro, both of Tenn.

[73] Assignee: International Comfort Products Corporation (USA), Nashville, Tenn.

[21] Appl. No.: 09/144,378

[22] Filed: Aug. 31, 1998

[51] Int. Cl.[7] ..... F23D 14/12

[52] U.S. Cl. ..... 431/114; 126/110 R

[58] Field of Search ..... 431/114, 188, 431/284; 126/110 R, 112, 99 R

[56] References Cited

U.S. PATENT DOCUMENTS

| | | | |
|---|---|---|---|
| 2,964,121 | 12/1960 | Zink, Jr. et al. | 431/114 |
| 3,748,085 | 7/1973 | Poepsel et al. | 431/114 |
| 3,907,489 | 9/1975 | Santisi | 431/114 |
| 3,940,234 | 2/1976 | Reed et al. | 431/114 |
| 4,029,462 | 6/1977 | Bitterlich | 431/114 |
| 4,417,868 | 11/1983 | Putnam | 431/1 |
| 4,998,877 | 3/1991 | Schilling et al. | 431/19 |
| 5,062,790 | 11/1991 | Loberger et al. | 431/114 |

FOREIGN PATENT DOCUMENTS

| | | | |
|---|---|---|---|
| 2048642 | 4/1972 | Germany | 431/114 |
| 1274414 | 5/1972 | United Kingdom | 431/114 |

*Primary Examiner*—James C. Yeung
*Attorney, Agent, or Firm*—Baker & Daniels

[57] ABSTRACT

An enclosure surrounding the burner of a furnace, including a top panel, a rear panel, a bottom panel, a front panel, and first and second side panels. An air inlet is provided in one of the panels. A baffle is provided within the enclosure and extends between two opposed panels, each of the opposed panels adjacent the panel having the inlet. A chamber is partly defined by the baffle, the inlet opening into the chamber. The chamber is provided with a vent through which the inlet is in fluid communication with the burner.

10 Claims, 4 Drawing Sheets

SOUND ENHANCING BURNER ENCLOSURE FOR FURNACE

BACKGROUND OF THE INVENTION

The present invention relates to burner enclosures, particularly burner enclosures for furnaces.

Burners of the type used in furnaces produce noises associated with the combustion of fuel within the furnace. Enclosure of the burners may help attenuate the transmission of these noises, but airborne sound emanating from within the enclosure may travel outward through the air inlet of such an enclosure. Further, sound transmission may occur through the walls of the enclosure. A means of reducing the transmission of noises emanating from within a furnace burner enclosure is desirable.

SUMMARY OF THE INVENTION

The present invention provides a sound enhancing enclosure for the burner of a furnace. The enclosure includes a top panel, a rear panel, a bottom panel, a front panel, and first and second side panels. An air inlet is provided in one of the panels. A baffle is provided within the enclosure and extends between two opposed panels, each of the opposed panels adjacent the panel which includes the inlet. A chamber is partly defined by the baffle and the inlet opening into the chamber. The chamber is provided with a vent through which the inlet is in fluid communication with the burner.

Further, the sheet metal material from which the enclosure is formed is of a thickness which provides sufficient mass to substantially attenuate the transmission of combustion-related noises therethrough.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Figure 1:
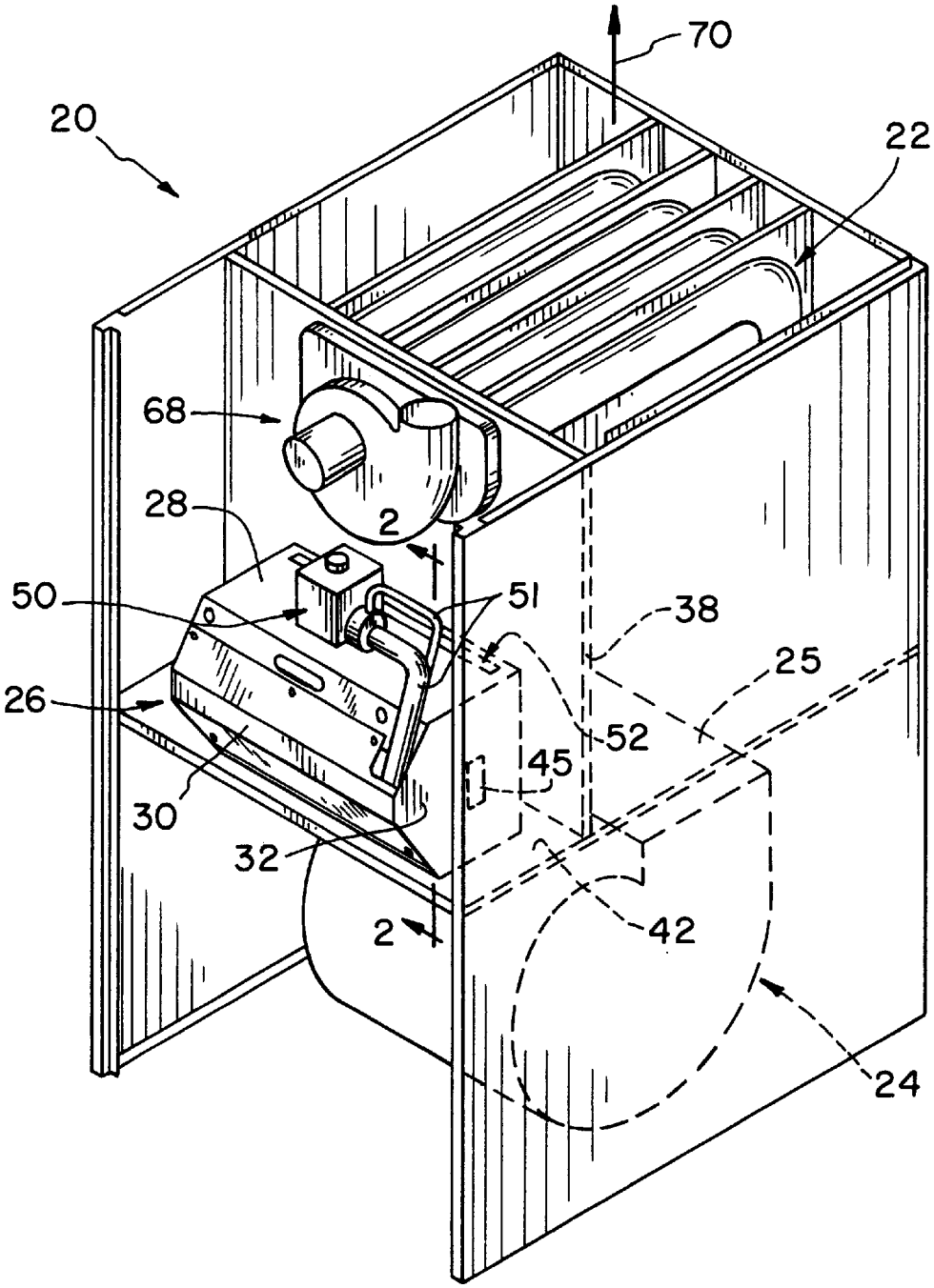
FIG. 1 is an upper rear perspective view of a partially assembled furnace cabinet, showing an embodiment of a burner enclosure according to the present invention.

Corresponding reference characters indicate corresponding parts throughout the several views. Although the drawings represent an embodiment of the present invention, the drawings are not necessarily to scale and certain features may be exaggerated in order to better illustrate and explain the present invention. The exemplification set out herein illustrate an embodiment of the invention, and such exemplification is not to be construed as being exhaustive or to limit the scope of the invention in any manner.

DETAILED DESCRIPTION OF THE INVENTION

FIG. 1 shows partially assembled furnace cabinet 20 which includes an embodiment of a burner enclosure according to the present invention. Cabinet 20 comprises heat exchanger 22 for transferring heat from the combustion gases generated by the burners of the furnace to conditioned air forced through heat exchanger 22 by blower assembly 24. The outlet 25 of blower 24 is directed upwardly as shown in FIG. 1. Cabinet 20 further comprises sound enhancing burner enclosure 26. Enclosure 26 comprises top panel 28; rear panel 30, which in the shown embodiment is multi-sided, having a plurality of angled flat surfaces; and first and second side panels 32, 34, respectively, which are located on opposite sides of enclosure 26. Enclosure 26 further comprises front panel 36, which is part of vertical heat exchanger vertical wall 38; and bottom panel 40, which is part of horizontal cabinet wall 42. Each side of enclosure 26 may be formed from 22 gauge (0.86 mm, 0.0336 inch thick) aluminized steel, a thickness which provides sufficient mass to attenuate combustion-related noise emanating from inside the burner enclosure. Horizontal cabinet wall 42, comprising bottom panel 40, may alternatively be formed from prepainted, galvanized steel. Further, top panel 28, rear panel 30 and side panels 32, 34 may be formed from a single sheet of steel and configured on a brake into the shape shown, the free edges of these panels attached together with screws or by means of spot welding.

Figure 7:
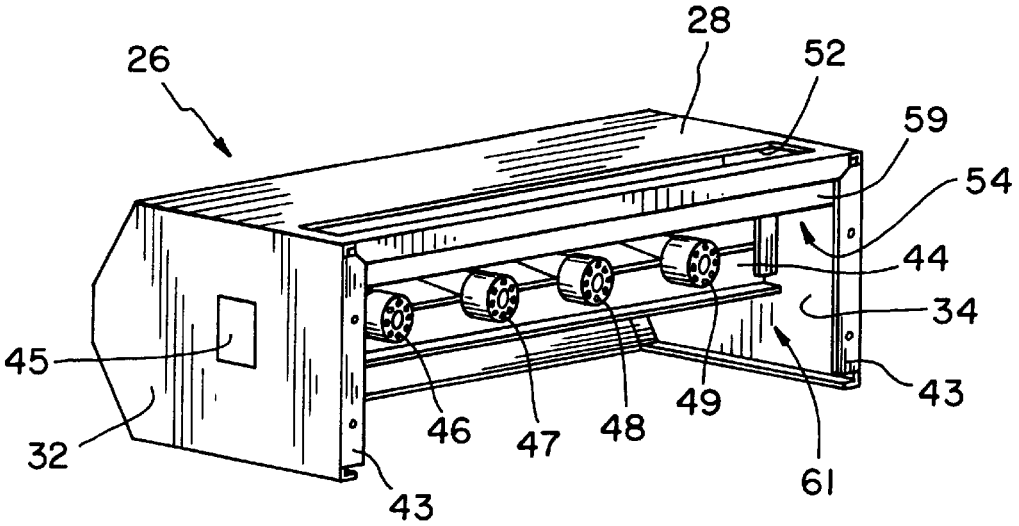
FIG. 7 is an upper front perspective view of the enclosure embodiment shown in FIG. 1.

Disposed within enclosure 26, attached to and extending between first and second side panels 32, 34, is burner support bracket 44. Panels 32, 34 are each provided with centrally located slotted relief 45 into which tabs (not shown) at opposite ends of bracket 44 are received for attachment of bracket 44 to enclosure 26. Attached to bracket 44 are individual burners 46, 47, 48 and 49, which may vary in number between two and six, based on the size and capacity of the furnace; four are shown in the illustrated embodiment. In the shown embodiment, the burners are gas fired and, for pilot and normal heating operation, are supplied with fuel by means of gas valve mechanism 50, and its attendant gas lines 51. Notably, the portion of the enclosure comprising top panel 28, rear panel 30 and first and second side panels 32, 34 may be formed separately and, with gas valve mechanism 50 and gas lines 51, bracket 44, and burners 46–49 may be installed into cabinet 20 as a sub-assembly. Side panels 32, 34 are provided with inwardly directed flanges 43 (FIG. 7) which lie along vertical wall 38 and are attached thereto by means of sheet metal screws (not shown) engaging holes provided therefor. The enclosure sub-assembly rests upon horizontal wall 42 but is not attached thereto. Thus, burners 46–49 are enclosed by enclosure 26.

Figure 3:
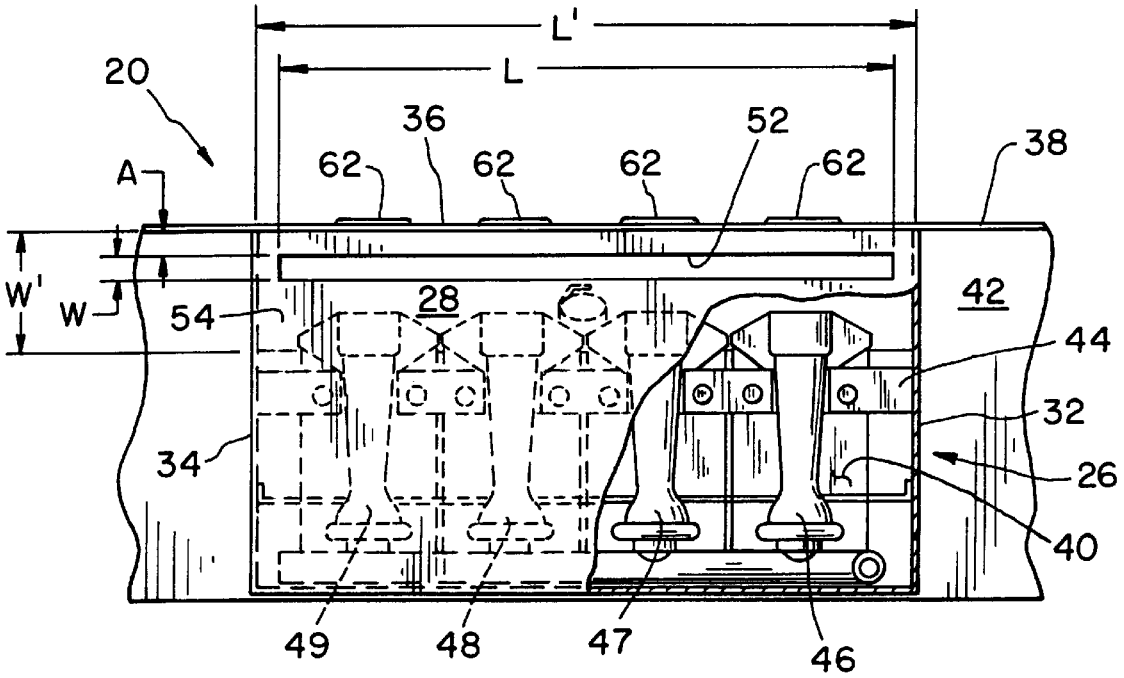
FIG. 3 is a fragmentary top view of the cabinet of FIG. 1 in which a portion of the burner enclosure has been broken away.
Figure 4:
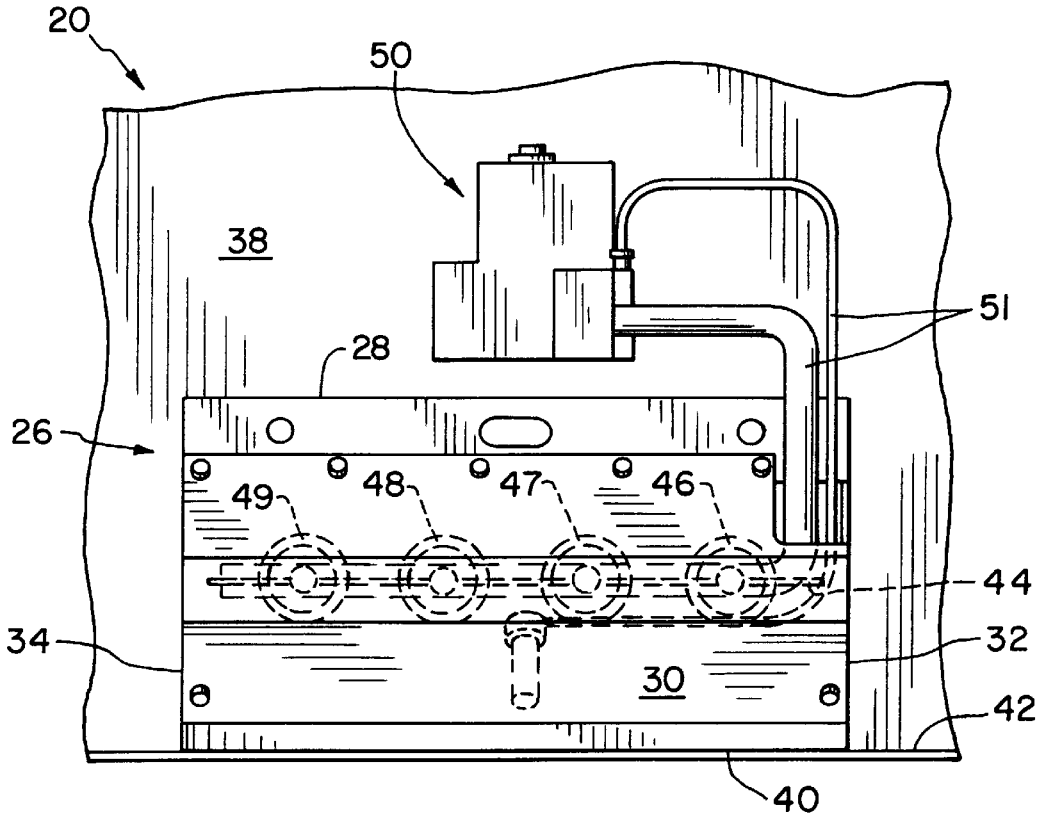
FIG. 4 is a fragmentary rear view of the cabinet of FIG. 1.
Figure 5:
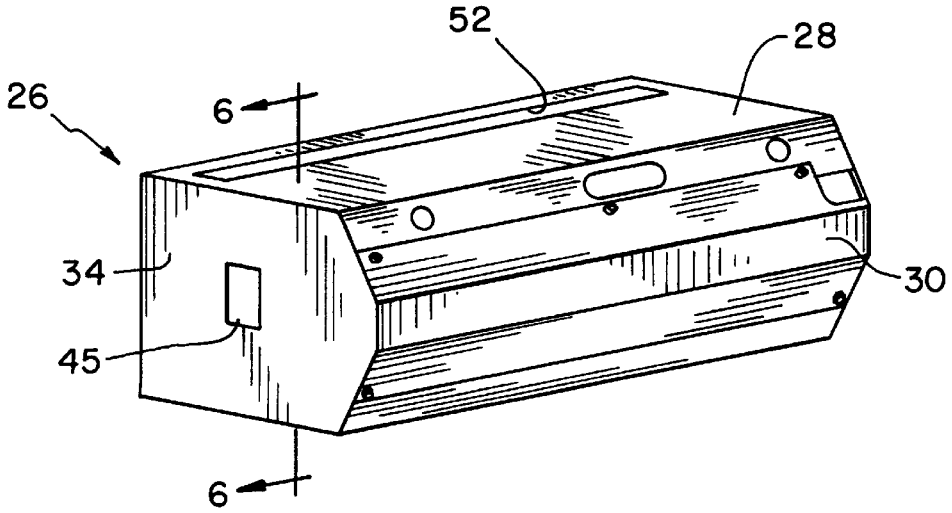
FIG. 5 is an upper rear perspective view of the enclosure embodiment shown in FIG. 1.

Referring now to FIG. 3, the length between panel walls 32, 34 is shown as dimension L', which ranges between approximately 275 mm and 500 mm, depending on the number of burners within the enclosure. Top panel 28 of enclosure 26 is provided with elongate air inlet 52 centered between side panels 32, 34 and having length L, which extends nearly the entire distance L', and width W of approximately ½ inch (13 mm). Air inlet 52 is located proximal vertical wall 38.

Figure 2:
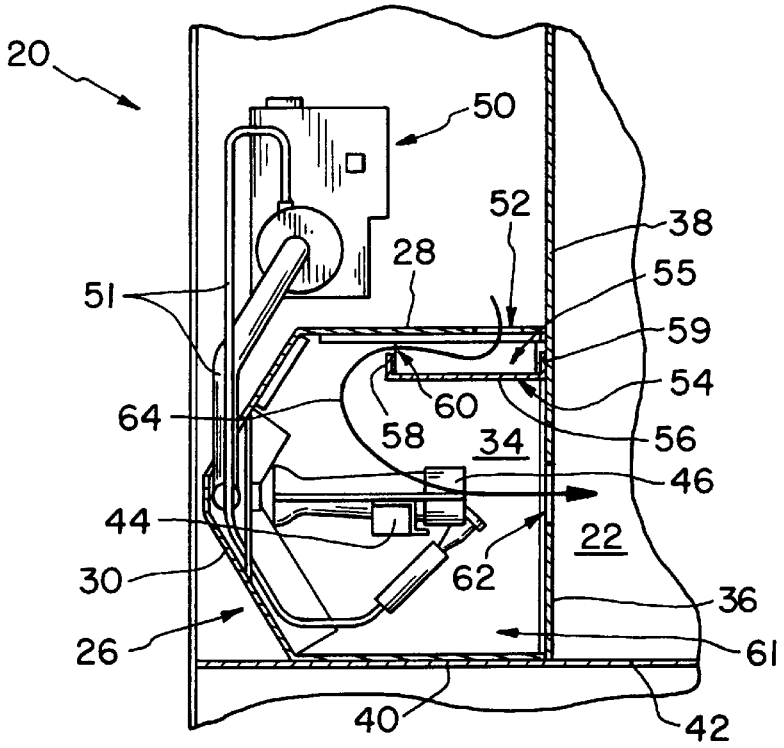
FIG. 2 is a fragmentary, sectional side view along line 2—2 of FIG. 1.
Figure 6:
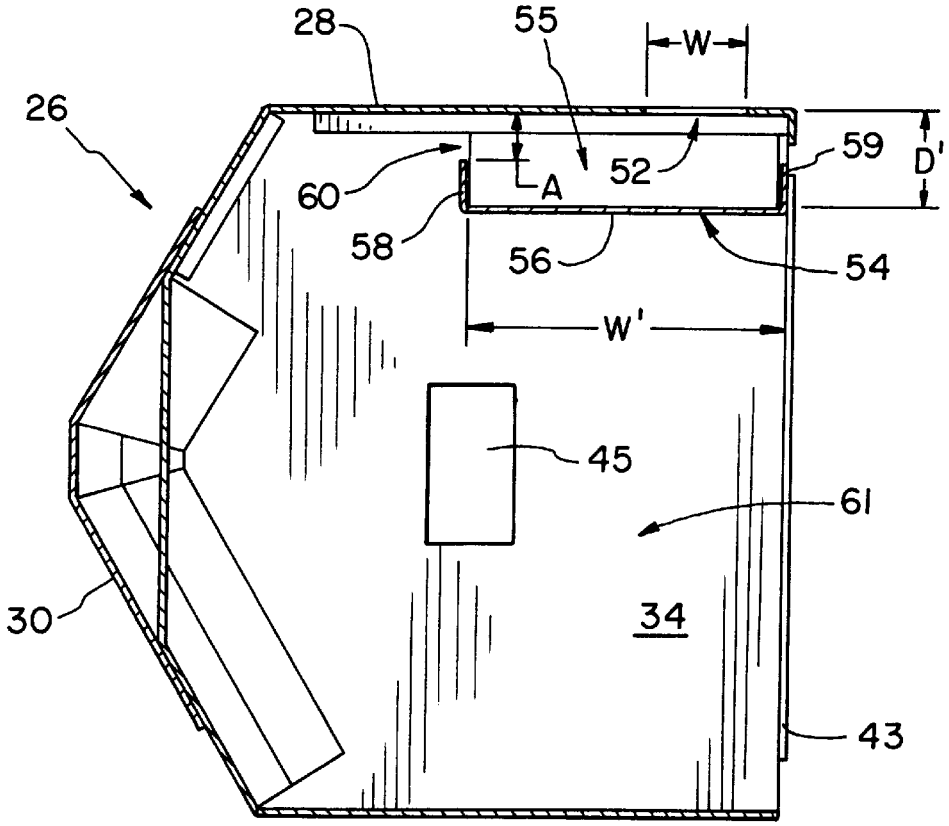
FIG. 6 is a sectional side view along line 6—6 of FIG. 5.

Referring to FIGS. 2, 3 and 6, enclosure 26 is provided with baffle 54 which is generally U-shaped in cross-section, having an approximately horizontal center portion 56 which extends between vertical legs 58, 59. Baffle 54, like the burner enclosure, may be formed from 22 gauge aluminized steel. Frontmost baffle leg 59 is located adjacent vertical wall 38. Baffle center portion 56 has width W' of approximately ½ inches (FIG. 3); the length of each vertical leg 58, 59 is approximately ½ inch. Baffle center portion 56 is located directly below inlet 52, at a distance D' (FIG. 6) of approximately one inch. Baffle 54 extends between and is attached to side panels 32, 34 and, with the side panels, top panel 28, and a portion of front panel 36, defines muffler chamber 55, which is best envisioned with reference to FIGS. 2 and 6. The free edge of rearmost vertical baffle leg 58 is disposed distance A below the lower surface of top panel 28, forming elongate vent 60 which extends the entire interior width of enclosure 26 and through which air exits muffler chamber 55. Air which supports combustion at the burners is thus introduced to enclosure 26 through inlet 52, and flows through chamber 55 and vent 60 before reaching main burner enclosure chamber 61. The gaseous combustion products exit chamber 61 through apertures 62 provided in vertical wall 38, entering heat exchanger 22. Baffle 54 serves as a barrier against airborne noise emanating from inside the burner enclosure, preventing its transmission from main burner chamber 61 to inlet 52.

The flow of combustion air and combustion products is represented by arrow 64 in FIG. 2, which shows air entering inlet 52, flowing through chamber 55 and vent 60, flowing through main enclosure chamber 61, and entering heat exchanger 22 as products of combustion through apertures 62. Referring to FIG. 1, combustion gases are exhausted from heat exchanger 22 through exhaust fan assembly 68. The heated conditioned interior air exits cabinet assembly 20 in the direction of arrow 70, from which it is ducted through a system of ventilation ducts to a building to be heated.

While this invention has been described as having a preferred design, the present invention may be further modified within the spirit and scope of this disclosure. This application is therefore intended to cover any variations, uses or adaptations of the invention using its general principles. Further, this application is intended to cover such departures form the present invention as come within known or customary practice in the art to which this invention pertains.

What is claimed is:

1. An enclosure surrounding the burner of a furnace, comprising:

a plurality of contiguous panels defining an enclosed space in which the burner is located;

an air inlet to said enclosed space in a first one of said panels; and an air baffle located within said enclosed space and having an edge which is spaced from said first panel, a gap defined by said edge and said first panel, said air baffle extending between second and third said panels, said second and third panels located on opposite sides of said enclosed space, each of said second and third panels adjacent said first panel, said air baffle partly defining a chamber within said enclosed space;

wherein said air inlet opens into said chamber, said chamber is provided with a vent defined by said gap through which air exits said chamber, and said air inlet is in fluid communication with the burner through said vent, the transmission of noise emanating from said enclosed space through said air inlet being reduced by said baffle.

2. The enclosure of claim 1, wherein said air baffle comprises a first leg and a second leg, said first leg generally parallel to said first panel, said second leg having said edge.

3. The enclosure of claim 1, wherein said air baffle is attached to a fourth said panel, said fourth panel being adjacent each of said first, second and third panels.

4. The enclosure of claim 1, wherein said air baffle is attached to said second and third panels.

5. The enclosure of claim 1, wherein said air baffle is elongate.

6. The enclosure of claim 5, wherein said air inlet is elongate.

7. The enclosure of claim 1, wherein one of said panels and said air baffle comprises sheet metal having a 22 gauge thickness.

8. The enclosure of claim 1, wherein one of said panels is multi-sided.

9. The enclosure of claim 1, wherein fourth and fifth said panels are generally mutually perpendicular and are furnace cabinet panels, and said enclosure comprises a subassembly comprised of said first, second and third panels, said subassembly attached to the furnace cabinet panels.

10. The enclosure of claim 9, wherein one of said fourth and fifth panels has an aperture through which said enclosed space and a heat exchanger are in fluid communication.

* * * * *